US005140889A

United States Patent [19]

Segan et al.

[11] Patent Number: 5,140,889

[45] Date of Patent: Aug. 25, 1992

[54] ELECTRONIC PERCUSSION SYNTHESIZER ASSEMBLY

[76] Inventors: Marc H. Segan, 20 East 9th St., New York, N.Y. 10003; Michael Newsome, One Magnolia Ave., Apt. 6, Jersey City, N.J. 07306

[21] Appl. No.: 742,141

[22] Filed: Aug. 1, 1991

Related U.S. Application Data

[63] Continuation of Ser. No. 469,155, Jan. 24, 1990.

[51] Int. Cl.[5] ..... G10G 5/00; G10F 1/08; G10H 3/12

[52] U.S. Cl. ..... 84/723; 84/743; 84/411 R; 84/420; 446/408; 446/418

[58] Field of Search ..... 84/104, 107-109, 84/112-113, 403, 411 R, 412, 421, DIG. 12, 402, 723, 743, 746, 725, 737, 742, 420; D17/22; D21/64, 59; 446/397, 408, 418, 422

[56] References Cited

U.S. PATENT DOCUMENTS

| | | | |
|---|---|---|---|
| 3,405,587 | 10/1968 | Meazzi et al. | 84/421 |
| 3,405,588 | 10/1968 | Della-Porta | 84/421 |
| 3,659,032 | 4/1972 | May | 84/711 |
| 3,673,909 | 7/1972 | Birnkrant | 84/403 |
| 4,312,259 | 1/1982 | Henrit | 84/411 |
| 4,418,598 | 12/1983 | Klynas | 84/636 |
| 4,479,412 | 10/1984 | Klynas | 84/DIG. 12 |
| 4,491,050 | 1/1985 | Franzmann | 84/746 |
| 4,593,596 | 6/1986 | Gauger | 84/421 |
| 4,691,611 | 9/1987 | May | 84/421 |
| 4,817,485 | 4/1989 | Bozzio et al. | 84/732 |
| 4,867,028 | 9/1989 | Jones | 84/735 |
| 4,911,056 | 3/1990 | Belli et al. | 84/402 |
| 5,042,356 | 8/1991 | Karch | 84/725 |

OTHER PUBLICATIONS

Tandy Corporation, Cat. No. 60-2341, "Inazuma" Electronic Drum Synthesizer.

*Primary Examiner*—William M. Shoop, Jr.
*Assistant Examiner*—Helen Kim
*Attorney, Agent, or Firm*—Cohen, Pontani, Lieberman & Pavane

[57] ABSTRACT

An electronic percussion synthesizer assembly incorporates a novel structure for supporting the drum heads. The novel supporting structure comprises a spider assembly (83) comprised of a plurality of legs (150) joined at one end for defining a hub (152) and secured at their free ends to the perimeter of the drum head (65) on the underside thereof. The spider assembly (83) minimizes mechanical damping of the striking surface and, where a plurality of drum heads (62, 63, 64, 65) are used, also minimiizes "cross talk" between the drum heads. A novel foot pedal control (120) for altering the sounds produced by the drum head is also disclosed.

16 Claims, 7 Drawing Sheets

65
4
85
84
89
83
3
3
4
86
80
73

80
81
82

FIG. 4
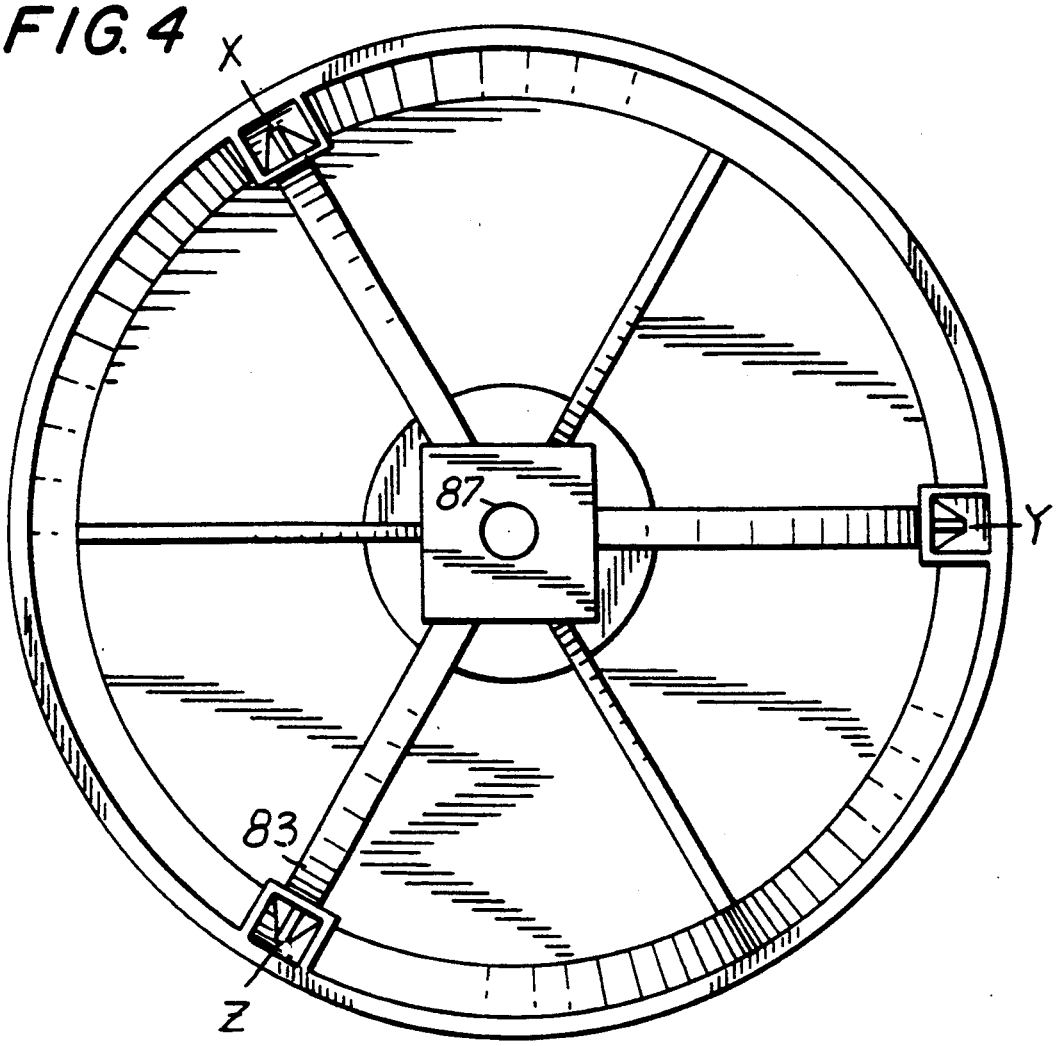
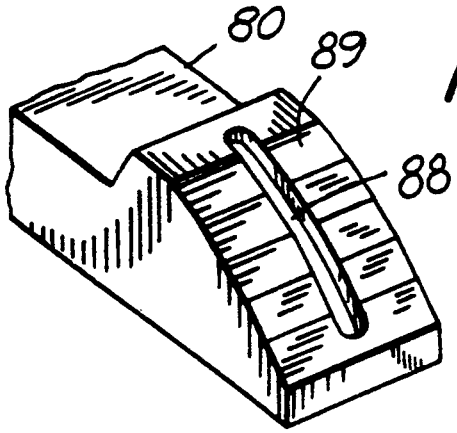
FIG. 5

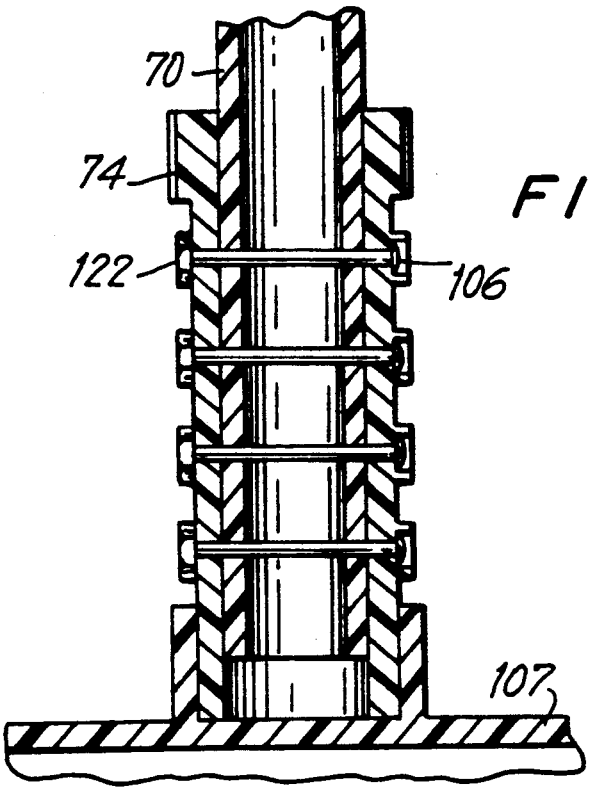
FIG. 8
FIG. 9
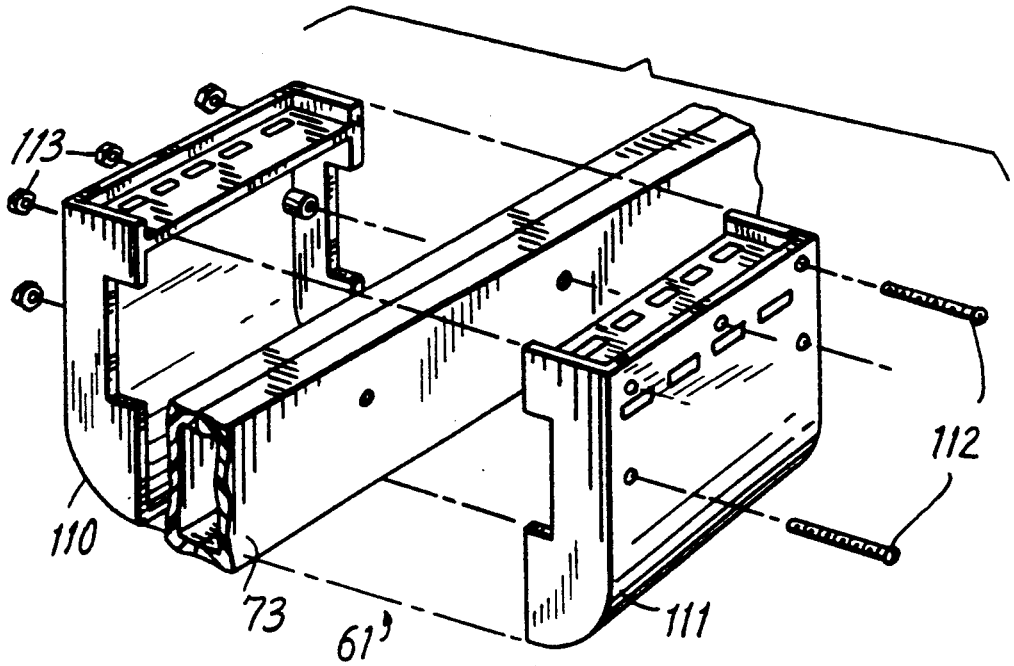

ELECTRONIC PERCUSSION SYNTHESIZER ASSEMBLY

This is a continuation of U.S. application Ser. No. 07/469,155, filed Jan. 24, 1990.

BACKGROUND OF THE INVENTION

1. Field of the Invention

This invention relates to electronic percussion synthesizer assemblies, and particularly to a novel structure for supporting the drum heads in such an assembly.

2. Prior Art

Electronic music instruments have been developed which generate sound entirely by electronic means. These devices, generally categorized as music synthesizers, generate electronic signals which are shaped and blended together to create different types of waveforms which can be amplified and played through conventional speakers to create different types of sounds.

Many of the earliest synthesizers, while capable of generating musical notes, could not be used to develop percussion rhythms in the same manner as they are developed using a conventional percussion instrument, the reason being most of the early synthesizers generally did not include a surface which may be struck in the manner of a percussion instrument to produce a percussion beat.

Various devices have recently been marketed which are capable of synthesizing the sounds of percussion instruments, such as drums. These devices include sound generating circuits which are responsive to analog pulses for generating sounds corresponding to the sounds of percussion instruments, with the amplitude of the sound generated being proportional to the amplitude of the analog pulse. Furthermore, these electronic percussion synthesizers include surfaces which may be struck with a drum stick for generating the analog pulses.

One example of an electronic percussion synthesizer is disclosed in U.S. Pat. No. 4,479,412. This patent describes an electronic percussion synthesizer which includes a plurality of pressure transducers, each representing a different percussion musical instrument. Each transducer is responsive to an external striking force for generating analog pulses, each pulse representing one beat of the respective musical instrument.

Most conventional electronic percussion synthesizers do not permit the adjustment of the drum heads to accommodate the specific requirements of each user. Rather, and as evidenced, for example, by the percussion synthesizer design depicted in FIG. 11 of U.S. Pat. No. 4,479,412, typically all four drum heads are fixedly and immovably encased in a single housing unit, and in such an arrangement it is a relatively simple matter to properly support the drum heads.

In this regard, electronic drum heads typically comprise a striking surface in contact with one or more piezoelectric transducers for converting mechanical movement of the striking surface to a proportional analog signal. Accordingly, it is important that the support structure for the drum head not unduly damp mechanical movement of the striking surface, as this would prevent the piezoelectric sensor from sensing a mechanical movement truly representative of the striking force. Furthermore, where all of the drum heads are interconnected by a mechanical structure, consideration should be given to "cross talk", i.e. mechanical vibration of one drum head being unintentionally transmitted to the others through the mechanical structure, which can cause the piezoelectric sensors for the other drum heads to produce unintended output signals. Also, in the case of toy electronic percussion synthesizers, it is important that the foregoing problems be resolved at minimal cost.

It is accordingly an object of the present invention to provide a novel structure for supporting the drum heads in an electronic percussion synthesizer assembly.

It is a further object of the invention to provide a structure for supporting the drum heads in an electronic percussion synthesizer assembly wherein the striking surfaces of the drum heads are free for undamped mechanical movement.

It is a still further object of the invention to provide an electronic percussion synthesizer assembly wherein cross talk among the drum heads is reduced.

It is yet another object of the invention to provide an electronic percussion synthesizer assembly which achieves the foregoing objectives at a minimal cost.

SUMMARY OF THE INVENTION

Broadly speaking, the invention is an improvement to electronic percussion synthesizer assemblies of the type comprising: a drum control unit; at least one drum head having an upper surface and incorporating a transducer for converting mechanical movement of the upper surface to an electrical signal indicative thereof, the transducer being electrically connected to said control unit; and a drum support member. The improvement comprises a spider assembly including a plurality of legs joined at one end for defining a hub, the legs extending radially outward from the hub in spaced relation, the free ends of the legs being secured to the perimeter of the underside of the drum head for supporting same; and means for securing said spider assembly to the drum support member.

In a preferred embodiment the spider assembly is integrally formed from flexible plastic and the legs are longer than the radius of the drum head, whereby the legs are bowed when secured to the bottom of the drum head.

The spider assembly of the invention economically and effectively achieves the goals of minimizing "dead" spots on the striking surface and, where the assembly incorporates a plurality of drum heads, of minimizing undesired "cross talk", the latter objective being achieved by the bowed legs which serve as shock absorbers for attenuating vibrations from the drum heads which would otherwise be transmitted to the frame.

The present invention also comprises an electronic percussion synthesizer incorporating an improved foot pedal control. Broadly speaking, the electronic percussion synthesizer in accordance with this aspect of the invention comprises a drum control unit; at least one drum head electrically connected to the control unit; and a foot pedal electrically connected to the control unit, the control unit including means for causing the drum head to play one sound when struck while the foot pedal is depressed and another sound when struck while the foot pedal is not depressed.

Other and further objects, advantages and features of the present invention will be understood by reference to the following specification in conjunction with the annexed drawings, wherein like parts have been given like numbers.

BRIEF DESCRIPTION OF THE DRAWINGS

FIG. 4 is a cross-sectional view substantially along line 4—4 of FIG. 2;

FIG. 5 is a perspective view showing the sloping section of a drum support arm;

FIG. 8 is a cross-sectional view of the height adjustment means substantially along line 8—8 of FIG. 1;

FIG. 9 is an exploded perspective view showing the control unit disposed integrally about the cross bar of the drum support member;

DETAILED DESCRIPTION OF THE PREFERRED EMBODIMENTS

The electronic percussion synthesizer assembly of the present invention comprises a structure accommodating adjustable mounting of one or more drum head units to a drum support member, thereby simulating an actual drum set-up and permitting drum head readjustment to accommodate the specific requirements of each user. In accordance with the invention, each drum head is supported at its periphery by a novel "spider" support structure which is both inexpensive and effective.

Figure 1:
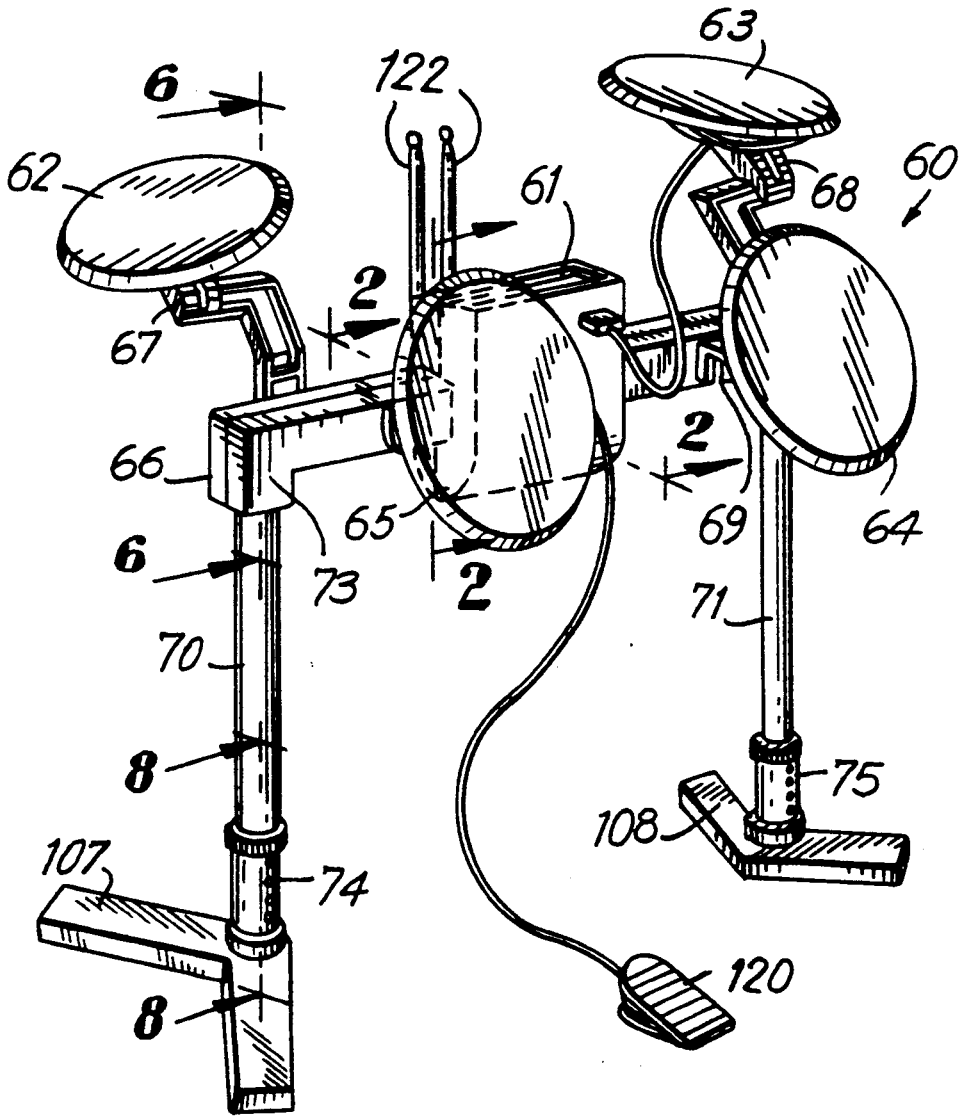
FIG. 1 is a perspective view of the electronic percussion synthesizer assembly according to the present invention.

The present invention can best be understood by referring to the attached drawings in which FIG. 1 depicts an electronic percussion synthesizer assembly according to this invention and generally designated by the reference numeral 60. As best shown in FIGS. 1-7, the electronic percussion synthesizer assembly 60 includes a drum control unit 61; four drum heads 62, 63, 64 and 65 electronically connected to control unit 61; a drum support member 66 comprising legs 70, 71 supporting a cross bar 73; four drum support arms 67, 68, 69 and 80 adjustably secured about drum support member 66; and means for adjustably mounting drum heads 62, 63, 64 and 65 to their respective drum support arms.

As best seen in FIG. 1, drum support member 66 comprises legs 70 and 71 attached to cross bar 73. Legs 70 and 71 are stabilized by bases 107 and 108, respectively, and include telescoping height adjustment tubes 74 and 75 for adjusting the height of cross bar 73. As best seen in FIGS. !, 9 and 10, control unit 61 is secured integrally about cross bar 73.

Each drum support arm 67, 68, 69 and 80 is adjustably mounted to cross bar 73. During play, it is contemplated that the user will stand or sit on the side of cross bar 73 supporting drum heads 64 and 65, and these drum heads and their respective support arms 69 and 80 are designated the front drum head assemblies. Likewise, the drum heads 62, 63 supported by drum support arms 67, 68 on the other side of the cross bar 73 are designated the rear drum head assemblies. As preferred and shown, the front drum head assemblies are structurally identical but differ somewhat from the rear drum head assemblies, which are also identical. In particular, the brackets comprising the front drum head assemblies define substantially right angles, whereas the brackets comprising the rear drum head assemblies define obtuse angles. As a consequence, and as best shown in FIG. 1, the rear drum heads 62, 63 are elevated relative to the front drum heads 64, 65. As should by now be appreciated, this is desirable as it makes the rear drum heads easier to reach when the user is on the side of the cross bar supporting front drum heads 64, 65. Indeed, and for the same reason, such an arrangement is common in professional drum sets wherein the drums nearest the player are lower than those farther away.

Figure 2:
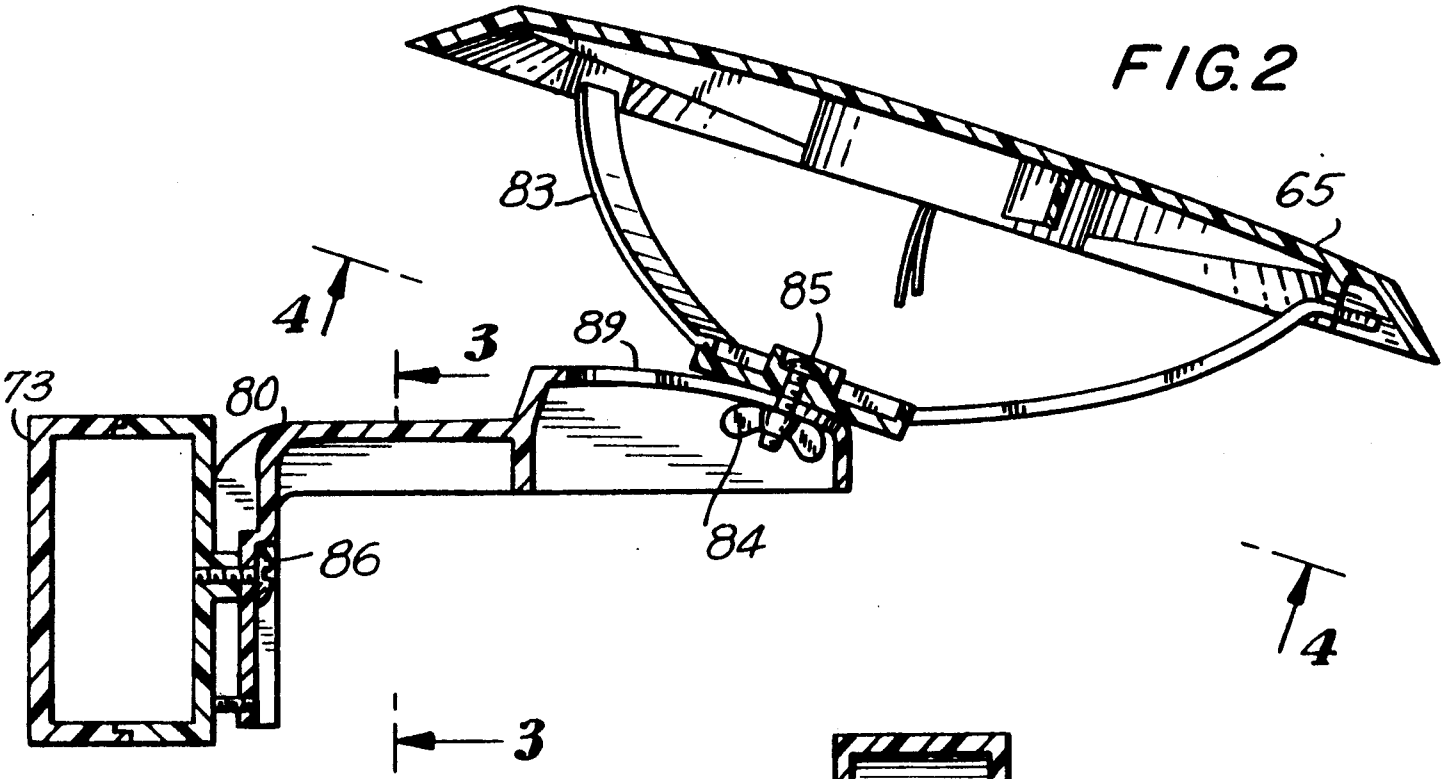
FIG. 2 is a cross-sectional view substantially along line 2—2 of FIG. 1.
Figure 3:
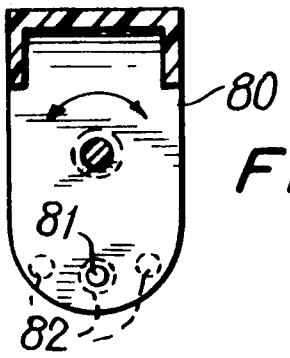
FIG. 3 is a cross-sectional view substantially along line 3—3 of FIG. 2.

Referring particularly to FIGS. 2 and 3, the front drum head assembly comprising drum support arm 80 and drum head 65 is attached to cross bar 73 by any mechanical means, such as a bolt 86. As preferred and shown, one end of drum support arm 80 includes an adjustment pin 81 disposed on a surface thereof confronting adjustment holes 82 in the cross bar 73, thereby permitting angular positioning of drum support arm 80, and hence drum head 65 at the other end thereof, in the direction indicated by the arrows in FIG. 3. That is, the angular position of drum support arm 80 is adjusted by pivoting support arm 80 about bolt 86 until pin 81 is aligned with the desired pin hole 82, whereupon the pin 81 is inserted in the hole for securing the support arm in the selected angular position. Each of the other drum support arms 67, 68, 69 is preferably secured to the cross bar 73 in the same manner as the drum support arm 80. Optionally, the drum support arms may be secured to cross bar 73 with ball joints.

Figure 12:
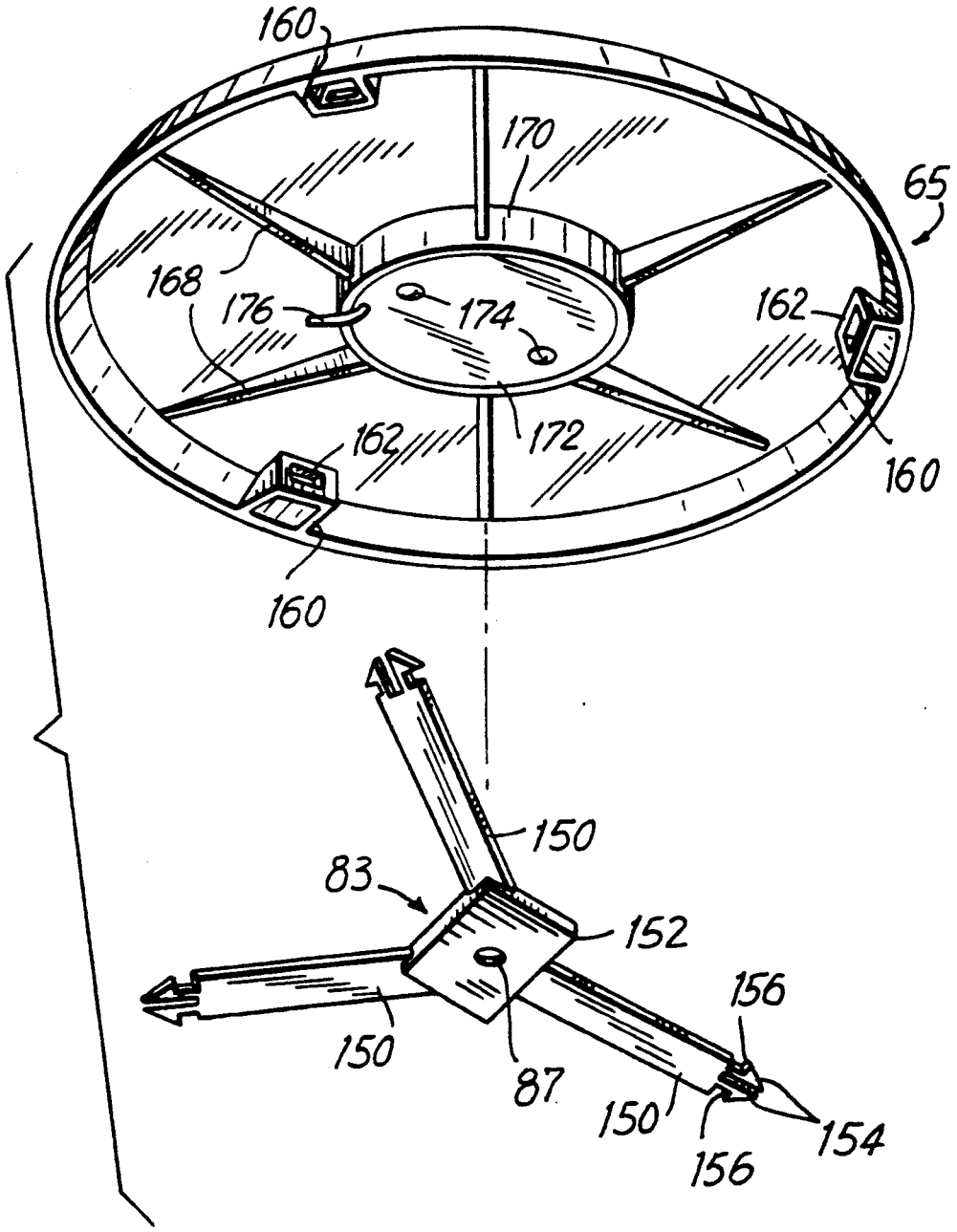
FIG. 12 is an exploded perspective view of a drum head and the spider assembly supporting same.

Referring now to FIGS. 2, 4 and 12 the manner in which front drum head 65 is adjustably mounted to drum support arm 80 will now be described, it being understood that each of the other drum heads is secured to its respective drum support arm in a like manner. As shown, drum head 65, which is of circular configuration to simulate a real drum head, is secured to its drum support arm 80 by an inverted "spider" assembly 83. The preferred spider assembly 83 has three radial legs 150 spaced 120 degrees apart and joined at one end to a rectangular hub 152 having a hole 87 in the center thereof. For reasons that will be apparent below, dual prongs 154 having outwardly extending tapered projections 156 extend from the free end of each leg 150. Although the legs 150 are preferred and shown as being 120 degrees apart, it will be appreciated that other configurations may be used. Likewise, while three legs 150 are preferred, two or more than three could also serve. The spider assembly 83 is preferably comprised of plastic, e.g. polypropylene and integrally formed as a planar assembly as shown in FIG. 12.

Still referring to FIG. 12, the peripheral underside of drum head 65 is formed with three equidistant, inwardly extending hollow bosses 160, each having a slot 162 on the face thereof confronting the center of drum head 65. The spider assembly 83 is secured to the drum head 65 by aligning the free ends of the legs 150 with the slots 162 and then squeezing the prongs 154 together and inserting them into their respective aligned slots. In this regard, the distance between the projections 156 is slightly wider that the width of the slots 162, such that after the prongs 154 are inserted in the slots and released, the projections abut the inside defining walls of the slot thereby preventing the prongs from slipping out of their respective slots. Note also that the radial distance from the hole 87 in the spider assembly 83 to the free ends of the legs 150 is greater than the radial distance from the center of the drum head 65 to its periphery, such that the legs 150 have to be flexed or bowed to insert them in the slots 162. As a consequence, and as best shown in FIG. 2, once the free ends of the legs 150 are inserted in the slots 162, the legs assume a permanently bowed configuration wherein the rectangular hub 152 is spaced from the center of the drum head 65. The rectangular hub 152 may then be secured to drum support arm 80 as by wing nut 84 and bolt 85, the latter passing through hole 87 in rectangular hub 152 and aligned slot 88 in drum support arm 80.

Like the spider assembly 83, the drum head 65 is also preferably comprised of plastic, desirably polypropylene. As shown in FIG. 12, the bottom of drum head is integrally formed with strengthening ribs 168 and a depending, centered hollow circular boss 170 in which a piezoelectric sensor 172 is secured, as by screws 174. As the use of piezoelectric sensors in electronic drum heads is well known, a detailed description is unnecessary. Suffice it to say that the piezoelectric sensor functions as a transducer for converting mechanical movement of the drum head to a proportional analog signal. That is, as the user strikes the drum head 65 with a drum stick, the resulting vibratory motion imparted to the drum head is converted to an analog electrical signal by the sensor 172, with the amplitude of the signal being proportional to the vibratory motion, and hence the force with which the drum head is struck. So, the harder the drum head is struck, the larger the amplitude of the electrical signal, and hence the louder the resulting sound when the electrical signal, after appropriate processing, is converted to sound by a speaker. In this regard, and as shown, the piezoelectric sensor 172 is connected to the control unit 61 via the wires 176.

It will now be appreciated that the spider assembly 83 is ideally suited for supporting the drum heads in the electronic percussion synthesizer assembly of the invention. In particular, because the spider assembly is only joined to the drum head at three discrete points on its periphery, the drum head has essentially no "dead spots". That is, as the drum head is struck, the resulting mechanical movement imparted to the drum head will be transmitted to the sensor 172 substantially without damping, whereby the sensor will respond with an electrical signal which is truly proportional to the force with which the drum head has been struck. Also, because the spider assembly 83 leaves substantially the entire drum head free for undamped vibratory motion, it has been found that each drum head can be served by a single, centrally located piezoelectric sensor 172, as the vibratory motion imparted to the drum head by striking any part of its upper surface will be freely transmitted across the entire upper surface, including across the central portion thereof in contact with the sensor 172. Furthermore, the bowed legs 150, being somewhat flexible, serve as shock absorbers in the sense that they damp the transmission of vibratory motion from the drum heads to their respective drum support arms 67, 68, 69 and 80. This is important, as all of the drum heads are mechanically connected via the cross bar 73, and consequently the vibratory motion imparted to one drum head may be at least partially transmitted to the other drum heads, thereby causing their respective piezoelectric sensors to produce unintended analog outputs or "cross talk". However, and as noted, the bowed legs 150 minimize this effect, as they damp any vibratory motion transmitted form their respective drum heads to the cross bar 73.

FIG. 5 depicts the sloping section 89 of support arm 80 which allows for the mounting of drum head 65 to support arm 80 in a variety of orientations. That is, the sloping section 89 includes a slot 88 for receiving the bolt 85 such that the drum head 65 may be secured to the support arm 80 in a range of angular orientations dependent on the profile of the sloping section 89. For example, if the pin 81 is in the center hole 82 and the bolt 85 is secured near the top of the slot 88, the drum head will be positioned in a substantially horizontal plane. On the other hand, if the bolt 85 is secured near the bottom of the slot 88 (FIG. 2) the drum head 65 will be angled toward the player. In lieu of the foregoing arrangement, here too a ball joint may be substituted for adjustably securing drum head 65 to support arm 80.

Figure 6:
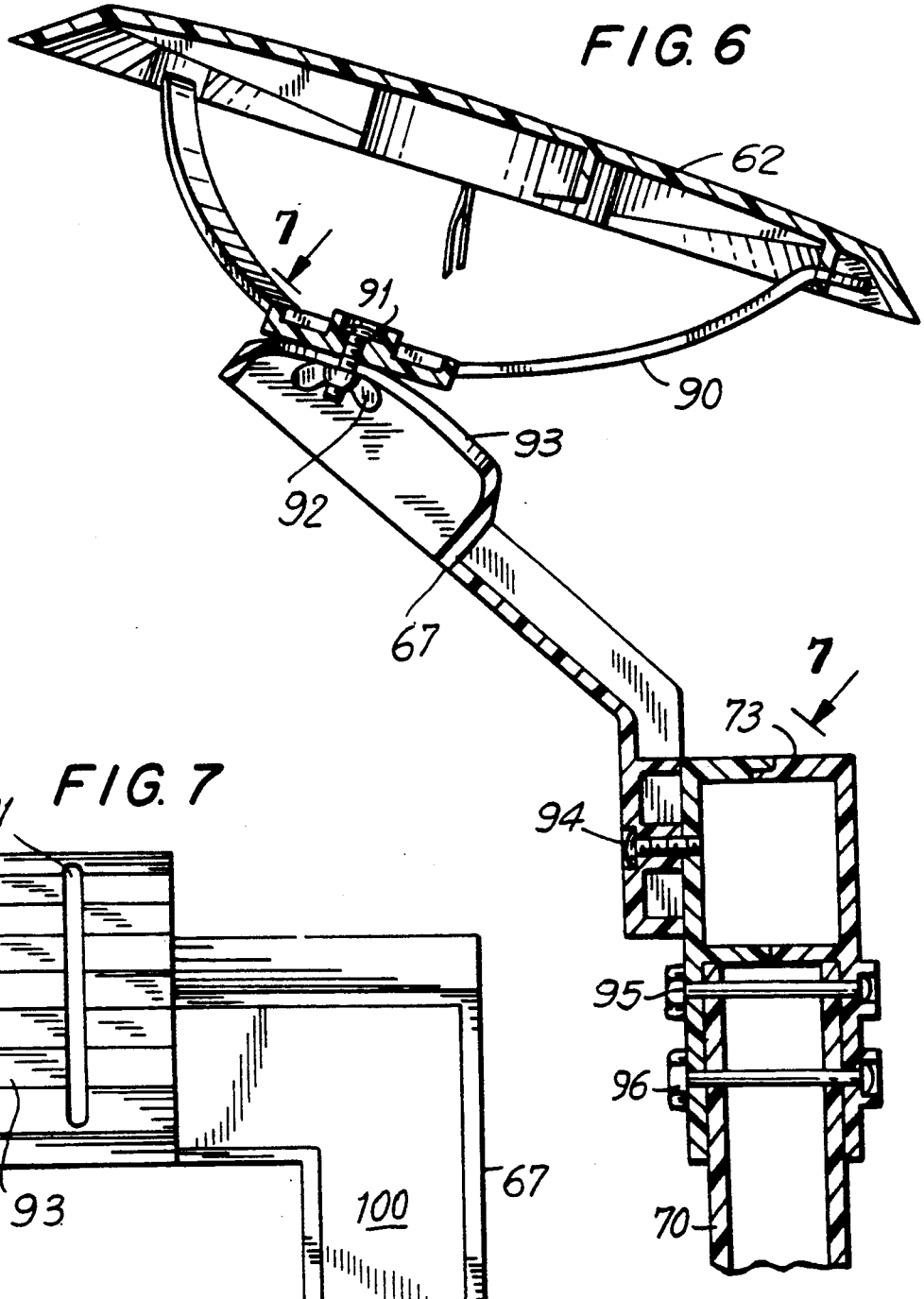
FIG. 6 is a cross-sectional view substantially along line 6—6 of FIG. 1.
Figure 7:
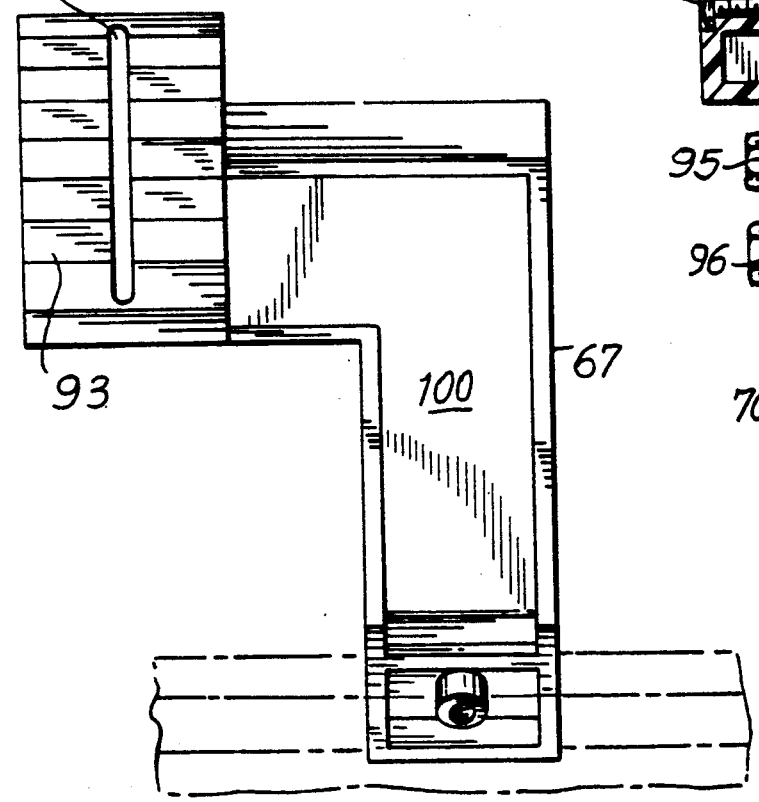
FIG. 7 is a view of a rear drum support arm substantially along line 7—7 of FIG. 6.

FIGS. 6 and 7 show rear drum head 62 adjustably mounted to its drum support arm 67. As is apparent from FIGS. 6 and 7, the rear drum head 62 is secured to its drum support arm 67 in the same manner that drum head 65 is secured to its drum support arm 80, i.e. bolt 91 and wing nut 92 secure tripod 90 in slot 101 in sloping section 93. FIG. 6 also shows that cross bar 73 is attached to leg 70 by bolts 95 and 96, it being understood that the other end of cross bar 73 is secured to leg 71 in a similar fashion.

FIG. 8 is a cross-sectional view along line 8—8 of FIG. 1, wherein it may be seen that the height of the cross bar 73 is adjusted via height adjustment tube 74 which telescopes about leg 70. In a well known manner, height adjustment tube 74 includes a plurality of through holes alignable with a through hole in the leg 70. As should by now be apparent, the height of the cross bar is set by aligning one of the through holes in the tube 74 with the hole in the leg and then securing the tube to the leg as by bolt 106 and nut 126. As preferred and shown, the tube 74 includes annular bosses at either end of the through holes therein both for reinforcing the point of attachment of tube 74 to leg 70 and for hiding the nut 122 and head of bolt 106 from view. Of course, and as shown in FIG. 1, a height adjustment tube 75 also telescopes about leg 71 so that both ends of cross bar 73 may be set at the same height. As also shown in FIG. 1, height adjustment tubes 74 and 75 are disposed in bases 107 and 108, respectively, to maintain stability of the assembly.

From the foregoing it will be apparent that owing to the manner in which the drum heads 62, 63, 64 and 65 are secured to the drum support arms 67, 68, 69 and 80 and the manner in which the drum support arms are secured to the cross bar 73, each drum head may be arranged in a variety of positions in accordance with the desire of the user. In addition, the overall height of the drum heads may be adjusted by raising or lowering the cross bar 73.

Figure 10:
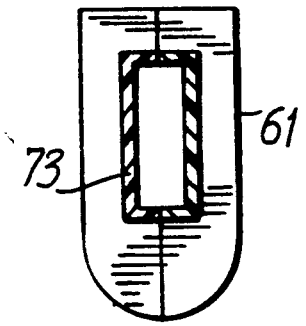
FIG. 10 is a cross-sectional view showing the control unit disposed integrally about the cross bar of the drum support member.

Referring now to FIGS. 9 and 10, control unit 61 is preferably integrally secured about cross bar 73. In particular, and as best seen in FIG. 9, control unit sections 110 and 111 are secured about cross bar 73 with bolts 112 and nuts 113. Preferably, the top of the cross bar 73 is provided with two blind holes for receiving drumsticks 122 (FIG. 1) when the drum assembly 60 is not in use.

Figure 11:
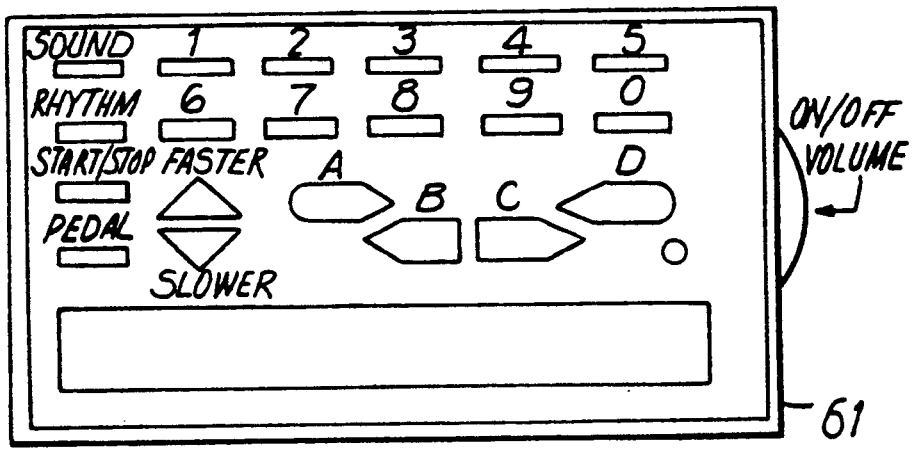
FIG. 11 is a top planar view of the control board of the control unit according to a preferred embodiment of the present invention.

The control unit 61 controls the sounds generated by the assembly 60 as the drum ,heads 62, 63, 64 and 65 are struck as by drumsticks 122. FIG. 11 depicts a preferred design configuration of the control buttons of the control unit. The "Sound" button selects which sound will be produced by each drum head. The "Rhythm" button selects which background rhythm will be played. The "Start/Stop" button starts and stops the background rhythm.

The "Pedal" button selects either bass drum or "shift" mode for the foot pedal. The "Faster" and "Slower" buttons make the background rhythm play faster and slower, respectively. The number buttons select sound or rhythm from a list of twenty possibilities for each. The drum head buttons A, B, C and D are used for programming the drum sounds for their corresponding drum heads.

When the control unit 61 is first turned on, the drums are set up to allow play immediately, i.e., hitting the drum heads will make drum sounds. The drum heads are impact sensitive, and the harder they are hit, the louder the drum sound will be. The bass drum sound from foot pedal 120 (see FIG. 1) is always at the maximum loudness.

The drums contain twenty pre-programmed rhythms. When the rhythms are playing, they are in the background, and you can play along on the drum heads. Pressing the "Start/Stop" button will turn a background rhythm on or off. To change the background rhythm, (1) turn off the rhythm using the "Start/Stop" button, (2) press the "Rhythm" button, (3) enter the number of the desired background rhythm on the number buttons, and (4) press the "Start/Stop" button to start the new background rhythm. While the background rhythm is playing, its tempo may be adjusted by pressing the "Faster" or "Slower" buttons.

The drums can produce twenty different drum sounds. The sound produced by each drum head can be changed using the keyboard of control unit 61. To select a specific sound by number: (1) press the "Sound" button, (2) enter the number of the desired sound, and (3) press the drum head button (A, B, C or D) for the drum head to be programmed. Each drum head can be programmed separately. Alternatively, the user can press the "Sound" button and then press the drum head button, whereupon the selected drum head will cycle through the available sounds. If the user then selects, e.g., a background rhythm by pressing the "Start/Stop" button, the control unit 61 will automatically select whatever sound had been cycled to that drum head at the time the "Start/Stop" button was pressed.

The control unit 61 also provides an adjustable background rhythm volume. The volume level of the background rhythms can be adjusted by pressing the keys numbered "1", "2", or "3" while the rhythm is playing, "1" being the softest and "3" being the loudest.

Normally, foot pedal 120 (see FIG. 1) produces a bass drum sound when pressed. Foot pedal 120 can also be programmed as a "shift", which will cause each drum head to make a different sound when struck with the pedal depressed than the sound it makes when the pedal is not depressed. In order to activate this feature, the user presses the "Pedal" button on control unit 61. This puts the pedal 120 in the shift mode. While in the shift mode, the user programs the sound to be heard when the drum head is hit while foot pedal 120 is depressed by first depressing foot pedal 120 and then following the procedure above for setting the drum head sound. Then, if the user strikes that drum head while the foot pedal 120 is depressed, the drum head will sound the programmed "shift" sound. At all other times the drum head will produce its initially programmed sound. With this feature, each drum head can produce two different sounds during play, one when the pedal is depressed and the other when the pedal is released.

To get out of the shift mode, the user simply again presses the "Pedal" button on the control unit 61. Foot pedal 120 will then return to the mode wherein it makes a bass drum sound when depressed.

While we have shown and described several embodiments in accordance with the invention, still further changes and variations will be apparent to those of ordinary skill in the art who read the description. Accordingly, the foregoing description should be construed as illustrative, and not in a limiting sense, the scope of the invention being defined by the appended claims.

We claim:

1. In an electronic percussion synthesizer assembly of the type comprising a drum control unit; at least one drum head comprising a substantially rigid material having an upper surface and incorporating a transducer for converting mechanical movement of said upper surface to an electrical signal indicative thereof, said transducer being electrically connected to said control unit; and a drum support member for supporting said drum head; the improvement comprising:

a spider assembly for said drum head comprising a plurality of legs joined at one end for defining a hub, said legs comprising a resilient, flexible material and extending radially outward from said hub in spaced relation from each other, the free ends of said legs being secured to the perimeter of the underside of said drum head for supporting same; and means for securing said spider assembly to said drum support member, said legs of said spider assembly flexing when the upper surface of its drum head is struck, thereby reducing damping of vibrations transmitted from said upper surface to said transducer and damping vibrations transmitted to said legs for reducing transmission of mechanical shocks to said drum support member.

2. The electronic percussion synthesizer of claim 1, further comprising a foot pedal electrically connected to said control unit, and wherein said control unit includes means for causing said at least one drum head to play one sound when said drum head is struck while said foot pedal is depressed and another sound when said drum head is struck when said foot pedal is not depressed.

3. The electronic percussion synthesizer of claim 1, further comprising at least one additional drum head, said additional drum head comprising a substantially rigid material having an upper surface and incorporating a transducer for converting mechanical movement of said upper surface of said additional drum head to an electrical signal indicative thereof, said transducer being electrically connected to said control unit;

an additional spider assembly for said additional drum head, said additional spider assembly comprising a plurality of legs joined at one end for defining a hub, said legs comprising a resilient, flexible material and extending radially outward from said hub in spaced relation from each other, the free ends of said legs being secured to the perimeter of the underside of said additional drum head for supporting same; and means for securing said additional spider assembly to said drum support member, said damping of vibrations transmitted to said legs of said spider assemblies also serving to reduce cross-talk between said drum heads.

4. The electronic percussion synthesizer of claim 3, further comprising a foot pedal electrically connected to said control unit, and wherein said control unit includes means for causing at least one drum head to play one sound when said drum head is struck while said foot pedal is depressed and another sound when said at least one drum head is struck when said foot pedal is not depressed.

5. The electronic percussion synthesizer of claim 3, wherein said drum heads are circular; the radial distance from said hubs to the free ends of their associated legs exceeds the radius of the respective drum head; and said means for securing said spider assemblies to said drum support member comprises means for securing said hubs to said drum support member in spaced relation from the underside of their respective drum head with said legs being bowed.

6. The electronic percussion synthesizer of claim 5, wherein said free ends of said legs are releasably secured to the perimeter of their respective drum heads.

7. The electronic percussion synthesizer of claim 6, wherein each drum head incorporates a plurality of bosses, one for each leg, formed on the perimeter of the underside thereof, each boss defining a slot for receiving the free end of one of said legs.

8. The electronic percussion synthesizer of claim 7, wherein said drum heads are comprised of plastic.

9. The electronic percussion synthesizer of claim 5, wherein said spider assemblies are comprised of plastic.

10. The electronic percussion synthesizer of claim 9, wherein said transducers are secured to the underside of their respective drum heads at the center thereof.

11. The electronic percussion synthesizer of claim 10, wherein said plurality of legs comprises three legs.

12. The electronic percussion synthesizer of claim 3, further comprising a plurality of drum support arms, one for each drum head, each support arm being secured at one end to said drum support member and at the other end to the respective spider assembly, and wherein said means for securing said spider assemblies to said drum support member comprises means for securing said spider assemblies to said other end of said drum support arms for movement relative thereto.

13. The electronic percussion synthesizer of claim 12, wherein said means for securing said other end of said support arms to said spider assemblies for movement relative thereto comprises said other end of said support arms including a surface having an elongate slot therein, and means for securing the respective hub at any position along said slot.

14. The electronic percussion synthesizer of claim 12, further comprising means for securing said one end of said drum support arms to said drum support member for movement relative thereto for accommodating additional adjustments in the position of said drum heads.

15. The electronic percussion synthesizer of claim 14, wherein said drum support member comprises a plurality of legs and a cross bar supported at either end by said legs, and wherein said one end of said drum support arms are secured to said cross bar.

16. The electronic percussion synthesizer of claim 15, wherein said control unit is secured to said cross bar.

* * * * *